US010837201B2

(12) United States Patent
Nicoara

(10) Patent No.: US 10,837,201 B2
(45) Date of Patent: Nov. 17, 2020

(54) FORTIFIED DEADBOLT LATCH

(71) Applicant: Rav Bariach (08) Industries Ltd, Ashkelon (IL)

(72) Inventor: Peter Nicoara, Ashdod (IL)

(73) Assignee: RAV BARIACH (08) INDUSTRIES LTD., Ashkelon (IL)

( * ) Notice: Subject to any disclaimer, the term of this patent is extended or adjusted under 35 U.S.C. 154(b) by 685 days.

(21) Appl. No.: 15/503,158

(22) PCT Filed: Aug. 10, 2015

(86) PCT No.: PCT/IL2015/050816
§ 371 (c)(1),
(2) Date: Feb. 10, 2017

(87) PCT Pub. No.: WO2016/024274
PCT Pub. Date: Feb. 18, 2016

(65) Prior Publication Data

US 2017/0226776 A1 Aug. 10, 2017

Related U.S. Application Data

(60) Provisional application No. 62/036,275, filed on Aug. 12, 2014.

(51) Int. Cl.
*E05B 63/12* (2006.01)
*E05B 47/00* (2006.01)
*E05B 15/10* (2006.01)

(52) U.S. Cl.
CPC ..... *E05B 63/126* (2013.01); *E05B 15/102* (2013.01); *E05B 47/004* (2013.01);
(Continued)

(58) Field of Classification Search
CPC ..... Y10T 292/06; Y10T 292/11
See application file for complete search history.

(56) References Cited

U.S. PATENT DOCUMENTS 1,083,173 A * 12/1913 Zeckhauser ..... E05B 65/0007 292/5
3,175,376 A * 3/1965 Cantwell ..... E05B 17/042 70/131

(Continued)

FOREIGN PATENT DOCUMENTS

EP 1717390 A2 * 11/2006 ..... E05B 15/102

*Primary Examiner* — Carlos Lugo
(74) *Attorney, Agent, or Firm* — The IP Law Firm of Guy Levi, LLC

(57) ABSTRACT

A deadbolt latching mechanism for a door. Specifically, the mechanism relates to a fortified deadbolt latch providing fortification against attempted prying of a door against the locking mechanism. A fortified deadlock latch device configured to reversibly move between an extended locked and retracted unlocked position, the device comprising: a. a latch housing having a longitudinal axis; b. a latching assembly, the latching assembly slidably coupled to the latch housing along the longitudinal axis; c. a bolt assembly coupled to the latching assembly, the bolt defining a circumferential surface; d. a rocker hingedly coupled to the bolt assembly, the rocker having a proximal end and a distal end, wherein, the distal end is configured to protrude beyond the bolt assembly's circumferential area and engage a frame jamb box in the extended position; and e. a bolt sleeve or a face plate, operably coupled to the latch housing.

19 Claims, 6 Drawing Sheets

(52) U.S. Cl.
CPC ..... *E05B 63/127* (2013.01); *E05B 63/12* (2013.01); *Y10T 292/06* (2015.04); *Y10T 292/11* (2015.04)

(56) References Cited

U.S. PATENT DOCUMENTS 3,582,119 A * 6/1971 Woodworth ..... E05B 63/127 292/27
4,566,725 A * 1/1986 Klein ..... E05B 63/127 292/191
4,615,550 A * 10/1986 Abate ..... E05B 63/127 292/192
4,725,086 A * 2/1988 Shen ..... E05B 63/06 292/1.5
4,768,817 A * 9/1988 Fann ..... E05B 63/06 292/1
4,895,404 A * 1/1990 Toledano ..... E05B 63/06 292/1.5
5,149,151 A * 9/1992 Shen ..... E05B 63/06 292/1.5
5,452,928 A * 9/1995 Donald ..... E05B 15/102 292/169.13
5,529,351 A * 6/1996 Donald ..... E05B 15/102 292/169.13
5,816,629 A * 10/1998 Donald ..... E05B 15/102 292/254
5,927,770 A * 7/1999 Huang ..... E05B 15/102 292/169.14
6,390,515 B1 * 5/2002 Huang ..... E05B 63/127 292/169.14
6,401,297 B1 * 6/2002 Huang ..... E05B 63/06 16/337
6,443,503 B1 * 9/2002 Fan Lu ..... E05B 63/06 292/1.5
6,443,504 B1 * 9/2002 Donald ..... G06K 9/00087 292/109
6,588,811 B1 * 7/2003 Ferguson ..... E05B 1/0007 16/320
6,764,112 B2 * 7/2004 Lan-Shi ..... E05B 63/06 292/1.5
7,036,851 B2 * 5/2006 Romig ..... E05B 65/0858 292/109
7,922,221 B2 * 4/2011 Fan ..... E05B 63/06 292/1.5
7,942,457 B1 * 5/2011 Bell ..... E05B 15/102 292/219
2009/0212576 A1 * 8/2009 Chang ..... E05B 63/06 292/1.5

* cited by examiner

FORTIFIED DEADBOLT LATCH

CROSS REFERENCE TO RELATED APPLICATIONS

This patent application is a U.S. National Phase filing of co-pending, commonly owned PCT Application No. PCT/IL2015/050816, filed Aug. 10, 2015, which is based on and claims the benefit of the filing date of U.S. Provisional Patent Application Ser. No. 62/036,275, filed Aug. 12, 2014, both which are incorporated herein by reference in their entirely.

BACKGROUND

The present disclosure is directed in general to a deadbolt latch mechanism for a door. Specifically, the disclosure is directed to a fortified deadbolt latch providing fortification, for example, against attempted prying of a door against the locking mechanism.

While in the past deadbolt locks have adequately secured doors and the like against unauthorized entry, they are continuously being subjected to unprecedented abuse and assault. Cylinder operated locks can be provided with ever-more sophisticated pick resistant cylinders, but picking the lock is not always the major problem to be guarded against. Rather, the lock mechanism, or more specifically the deadbolt, can often be pried from its setting by a crowbar or similar tool. Escutcheons can be provided to encircle a lock cylinder to prevent a tool being inserted into the door adjacent the periphery of the cylinder and used to pry the cylinder out of the lock (see e.g., U.S. Pat. No. 4,593,546)

For example, U.S. Pat. No. 5,758,527 discloses a high security deadbolt lock assembly, which is mounted in a transverse bore extending between the inner and outer surfaces of the door. The deadbolt is reciprocal within the housing between extended, locked and retracted, unlocked positions. In the retracted, unlocked position, the deadbolt extends substantially the entire length of the housing. At its inner end, that is the end of the deadbolt within the door, the deadbolt defines a generally U-shaped, inwardly opening recess. A cylindrical actuator member is rotatively supported within the housing within a drive or mounting block which is received and aligned within the recess in the bolt. The actuator is rotatable between locked and unlocked positions by means of the lock cylinder or other mechanical means such as a thumb turn. The actuator member carries a stop, which in the locked position, is rotated into engagement with an axially extending bearing surface of the bolt within the recess. A piston, which is reciprocable within a bore in the mounting block, serves to apply an outwardly biasing force against a flattened bearing surface on the cylindrical actuator member. As disclosed, the actuator member carries a drive arm which is pivotally secured to one end of a link. The opposite end of the link is pivotally secured to the deadbolt. When the deadbolt is extended to a locked position, a substantial portion of the length of the deadbolt remains confined within the housing. In the locked position, the drive arm and the link are non-axial and are disposed at an angle with respect to one another so that attempts to dislodge or force the bolt inwardly from a locked position are resisted by the engagement of the stop and the bearing surface within the deadbolt recess.

Alternatively, U.S. Pat. No. 7,418,847, discloses an apparatus for preventing a deadbolt lock from being opened from the outside of a door with a key. The apparatus includes a base constructed from resilient material defining at least one aperture for receiving various types of finger actuators in various orientations. the aperture is shaped to prevent the finger actuator from rotating relative to the base. A U-shaped plate is coupled to the base and is moveable between an extended position wherein the U-shaped plate is engageable with a member extending outwardly from the door and a storage position wherein the U-shaped plate is adjacent to the base. When a finger actuator is in the locked position and inserted into the aperture, and when the removable U-shaped plate is engaged with the member extending outwardly from the door, the finger actuator is prevented from moving into the unlocked position.

However, little if no protection is given to the locking mechanism when the bolt is pried from the jamb box in a direction perpendicular to the door hinge.

In addition, deadbolt latches tend to lock when a door a swung shut using force (slamming), this may result in inconvenience by being "locked out" of an entrance.

Therefore there is a need for a fortified deadbolt latch that can provide additional protection against prying attempt, as well as door slamming.

SUMMARY

In an embodiment, provided herein is a fortified deadbolt latch device configured to reversibly move between an extended locked and retracted unlocked position, the device comprising: a latch housing having a longitudinal axis; a latch actuator assembly, the latch actuator assembly slidably coupled to the latch housing along the longitudinal axis; a bolt assembly coupled to the latch actuator assembly, the bolt defining a circumferential surface; a rocker coupled (e.g., hingedly coupled) to the bolt assembly, the rocker having a proximal end and a distal end, wherein, the distal end is configured to protrude beyond the bolt assembly's circumferential area and engage a frame jamb box in the extended position; and a bolt sleeve or a face plate, operably coupled to the cylindrical housing.

In one embodiment, provided herein is a fortified deadbolt latch device configured to reversibly move between an extended locked and retracted unlocked position, the device comprising: a latch housing having a longitudinal axis; a latch actuator assembly, the latch actuator assembly slidably coupled to the latch housing along the longitudinal axis; a bolt assembly coupled to the latch actuator assembly, the bolt defining a circumferential surface; a rocker coupled (e.g., hingedly or otherwise, for example a live hinge meaning a narrowing in the thickness of an otherwise constant resilient metal connection) to the bolt assembly, the rocker having a proximal end and a distal end, wherein, the distal end is configured to protrude beyond the bolt assembly's circumferential area and engage a frame jamb box in the extended position; and a bolt sleeve or a face plate, operably coupled to the cylindrical housing, wherein the latch actuator assembly is further coupled to a locking cylinder (see e.g., 90, FIG. 8) and a finger lever, such that rotating a key in the locking cylinder, or rotating the thumb lever is configured to reciprocally maneuver the bolt from a retracted unlocked position, to an extended locked position.

In another embodiment, provided herein is a slam-proof deadbolt latch device configured to reversibly move between an extended locked and retracted unlocked position, the device comprising: a latch housing having a longitudinal axis; a latch actuator assembly, the latch actuator assembly slidably coupled to the latch housing along the longitudinal axis, wherein the latch actuator assembly comprises a pair of rails having a flared proximal end and a flared distal end and wherein each of the flared proximal end and distal end forms a surface perpendicular to the longitudinal axis; a bolt assembly coupled to the latch actuator assembly; a magnet coupled to the bolt, wherein the magnet abuts the distal end of the latch actuator assembly; and a bolt sleeve or a face plate, operably coupled to the cylindrical housing.

In another embodiment, provided herein a method of bolting a door, comprising providing a door having a fortified deadbolt latch device configured to reversibly move between an extended locked and retracted unlocked position, the device comprising: a latch housing having a longitudinal axis; a latch actuator assembly, the latch actuator assembly slidably coupled to the latch housing along the longitudinal axis; a bolt assembly coupled to the latch actuator assembly, the bolt defining a circumferential surface; a rocker operable coupled (e.g., hingedly or otherwise) to the bolt assembly, the rocker having a proximal end and a distal end, wherein, the distal end is configured to protrude beyond the bolt assembly's circumferential area and engage a frame jamb box in the extended position; and a bolt sleeve or a face plate, operably coupled to the cylindrical housing, wherein the latch actuator assembly is further coupled to a locking cylinder (see e.g., 90, FIG. 8), and a finger lever (see e.g., 800, FIG. 8), such that rotating a key in the locking cylinder, or rotating the thumb lever is configured to reciprocally maneuver the bolt from a retracted unlocked position, to an extended locked position; closing the door; and rotating the thumb lever or rotating a key in the locking cylinder, thereby moving the bolt from a retracted unlocked position to an extended position.

In yet another embodiment, provided herein is a kit comprising a fortified deadbolt latch device configured to reversibly move between an extended locked and retracted unlocked position, the device comprising a latch housing having a longitudinal axis; a latch actuator assembly, the latch actuator assembly slidably coupled to the latch housing along the longitudinal axis; a bolt assembly coupled to the latch actuator assembly, the bolt defining a circumferential surface; a rocker coupled (e.g., hingedly) to the bolt assembly, the rocker having a proximal end and a distal end, wherein, the distal end is configured to protrude beyond the bolt assembly's circumferential area and engage a frame jamb box in the extended position; and a bolt sleeve or a face plate, operably coupled to the cylindrical housing; a lock cylinder; optionally: a handle, a key, a finger lever, a rosette, an escutcheon, or a combination comprising one or more of the foregoing; optionally packaging; and optionally instructions.

In another embodiment, provided herein is a door, a window, a portal, a lid, a cover or an opening closure slab, comprising: a fortified deadbolt latch device configured to reversibly move between an extended locked and retracted unlocked position, the device comprising a latch housing having a longitudinal axis; a latch actuator assembly, the latch actuator assembly slidably coupled to the latch housing along the longitudinal axis; a bolt assembly coupled to the latch actuator assembly, the bolt defining a circumferential surface; a rocker coupled (e.g., through a gear transfer) to the bolt assembly, the rocker having a proximal end and a distal end, wherein, the distal end is configured to protrude beyond the bolt assembly's circumferential area and engage a frame jamb box in the extended position; and a bolt sleeve or a face plate, operably coupled to the cylindrical housing.

These and other features of the fortified deadbolt latch and slam-proof devices described herein will become apparent from the following detailed description when read in conjunction with the drawings, which are exemplary, not limiting, and wherein like elements are numbered alike in several figures.

BRIEF DESCRIPTION OF THE DRAWINGS

For a better understanding of the fortified deadbolt latch and slam-proof deadbolt latch described herein, with regard to the embodiments thereof, reference is made to the accompanying drawings, in which like numerals designate corresponding elements or sections throughout and in which.

DETAILED DESCRIPTION

Figure 1:
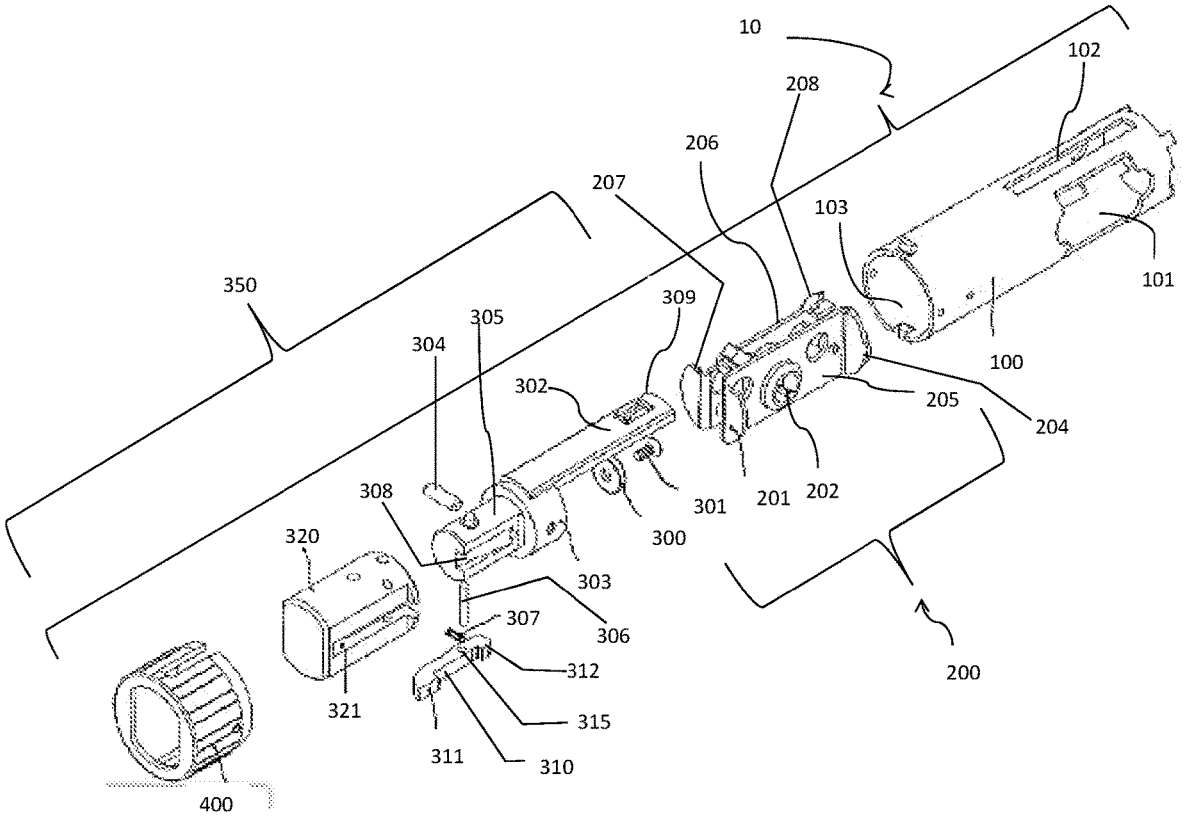
FIG. 1, shows an exploded view of an embodiment of the fortified deadbolt latch device described herein.

Provided herein are embodiments of a deadbolt latch mechanisms for a door. In another embodiment, provided herein are fortified deadbolt latches providing fortification, for example, against attempted prying of a door against the locking mechanism.

Commonly, locked doors which are encountered within a structure, can be forcibly opened using a tool such as a "Haligan" crowbar type tool. The Haligan crowbar can be very large and chances that a burglar would use such a tool are quite remote. Under most circumstances, either a knife, a screw-driver or a small crowbar will be used. The flat edge of the tool will most likely be inserted between the door and the frame at the vicinity of the bolt, leverage will be applied in a direction perpendicular to the door's hinge direction (See e.g., direction 'B' in FIG. 8), sufficient to bend the jamb to disengage the latch from the strike upon the door jamb permitting unauthorized entry. Fortifying the deadbolt latch assembly to resist the prying action may be the difference between a break-in and securing the location.

On other occasions, for example, when the door or the opening closure is horizontal, such as in a top of a box or boat cabin, prying may be attempted in a direction that is parallel to the hinges direction. Again sufficient force to bend the jamb may be applied, to disengage the latch from the strike plate upon the door jamb permitting unauthorized entry.

Accordingly, provided herein is a fortified deadbolt latch device configured to reversibly move between an extended locked and retracted unlocked position, the device comprising a latch housing having a longitudinal axis; a latch actuator assembly, the latch actuator assembly slidably coupled to the latch housing along the longitudinal axis; a bolt assembly coupled to the latch actuator assembly, the bolt defining a circumferential surface; a rocker hingedly coupled to the bolt assembly, the rocker having a proximal end and a distal end, wherein, the distal end is configured to protrude beyond the bolt assembly's circumferential area and engage a frame jamb box in the extended position; and a bolt sleeve or a face plate, operably coupled to the cylindrical housing.

The fortified deadbolt latch device can be moved between an extended locked position, or retracted unlocked position using a key to be opened from the outside and either a key or a finger lever to be opened from the inside. In an embodiment, the bolt assembly used in the fortified deadbolt latch devices described herein can further comprise a bolt extension coupled to and movable with a bolt base; a bolt base; a bolt having a longitudinal axis, the bolt defining a beveled channel therein along the longitudinal axis, configured to receive at least a portion of the rocker; and a bolt head, disposed over the bolt and defining a slit therein, adapted to allow reversible movement of the rocker. The beveled channel can be recessed in the bolt such that its distal end is deeper than its proximal end. The depth of the channel recessed in the bolt portion can be configured to accommodate the distal end of the rocker such that it does not extend (in other words, protrudes) beyond the external surface of the bolt assembly as defined by the circumference of the bolt head.

The slit defined in the bolt head can extend between about 20% to about 90% of the longitudinal length of the bolt head. As indicated, the surface of the bolt head can be configured to be frictionally slidable through the bolt head sleeve and/or the face plate and the strike plate coupled to the frame (or another door's) jamb box. The slit width therefore can be configured to allow at least a portion (e.g., the distal end of the rocker comprising the lip) to protrude through the surface.

The lip can protrude through the surface to a height of between about 1 mm and about 5 mm, for example, 3 mm. Accordingly and in an embodiment, provided herein is a fortified deadbolt latch device configured to reversibly move between an extended locked and retracted unlocked position, the device comprising: a latch housing having a longitudinal axis; a latch actuator assembly, the latch actuator assembly slidably coupled to the latch housing along the longitudinal axis; a bolt assembly coupled to the latch actuator assembly, the bolt defining a circumferential surface; a rocker hingedly coupled to the bolt assembly, the rocker having a proximal end and a distal end, wherein, the distal end is configured to protrude radially beyond the (optionally cylindrical) bolt assembly's circumferential area to a height (or a distance) of between about 1 mm and about 5 mm, for example, 3 mm, and engage a frame jamb box in the extended position.

A person skilled in the art would recognize, that although reference is made here to the bolt assembly's circumferential area and the lip protruding radially, these terms do not negate the bolt having shapes other than cylindrical shapes and can have cross sections defining a polygon having no less than 3 (three sides). Likewise, the bolt can have a combination of rounded and straight sides with the strike plate having at least one side that abuts the circumference of the bolt (but do not need to abut all sides).

The term "coupled", including its various forms such as "operably coupling", "coupling" or "couplable", refers to and comprises any direct or indirect, structural coupling, connection or attachment, or adaptation or capability for such a direct or indirect structural or operational coupling, connection or attachment, including integrally formed components and components which are coupled via or through another component or by the forming process. Indirect coupling may involve coupling through an intermediary member or adhesive, or abutting and otherwise resting against, whether frictionally or by separate means without any physical connection.

In addition, the term "slidably" or "slidably coupled" refers to movement of one surface (for example the latch actuator assembly) over a second surface (for example, the housing) while maintaining smooth continuous contact between the two surfaces. In another embodiment, the term "slidably coupled" means a state in which two or more components are coupled to one another such that at least one of the components (e.g., the latch actuator assembly) at least slides with respect to another component (e.g., the housing). Likewise; the terms "slide," "slid" or "sliding" are defined as moving, gliding or passing along or through a surface, although continuous contact at each point along the path is not necessarily required.

The term "engage" and various forms thereof, when used with reference to retention of the rocker arm lip protruding from the circumference of the bolt in the jamb box or against the strike plate (or cup, tube and the like), refer to the application of any forces that tend to hold the lip and strike plate together against inadvertent or undesired separating forces (e.g., such as may be introduced during attempts to pry the bolt). It is to be understood, however, that engagement does not in all cases require an interlocking connection that is maintained against every conceivable type or magnitude of separating force.

The rocker used in the fortified deadbolt latch described herein can be a rocker arm, in other words, an oscillating lever that conveys radial movement resulting from motion about an axle disposed in the rocker arm and is operably coupled to the bolt, to a linear motion engaging at the extended locked position and disengaging at the retracted unlocked position, the frame jamb box or strike plate. The rocker arm can be a slab having a generally curved or angled surface on one of its faces (or sides, walls, edges) with a width that can be configured to be received in the channel disposed in the bolt. The rocker arm can have a distal end and a proximal end disposed at the ends of a longitudinal axis and comprises a lip disposed on the distal end, wherein the lip is configured to engage a frame jamb box or a strike plate or both. The lip engaging the frame's jamb box does not necessarily need to be flat and can have any shape adapted to engage the strike plate. Moreover, it should be understood that whenever the term "frame jamb box" or "strike plate" is used herein, the jamb box and strike plate coupled to it can be in another door and does not need to be in a fixed structure. In addition, the strike plate does not necessarily need to be a plate defining an opening therein configured to receive the bolt and bolt head. The strike plate can be for example, a cup, a tube and the like defining a recess configured to receive and engage the protruding portion of the rocker arm. Further, the strike plate can be made of any appropriate material commensurate with the expected use of the door, for example, (reinforced) steel, plastic or brass.

Also, a rocker bore can be defined through the narrow aspect of the rocker arm and configured to receive and engage an axle pin. The location of the bore can be, for example, at any point along the longitudinal axis of the rocker arm and does not have to be centered. The axle pin used in conjunction with the rocker arm of the fortified deadbolt latch described herein can be operably coupled to the bolt, such that the rocker is hingedly coupled to the bolt. The term "hingedly coupled," as used herein, means that two or more members (e.g., the rocker arm and the bolt) are flexibly connected at a joint such that at least one member (e.g., the rocker arm) can move relative to the other(s) (e.g., the channel recessed within the bolt), for example, about an axis created in an embodiment by the axle pin engaged within the rocker bore. Further, the rocker arm can have a tab disposed on the proximal end, the tab configured to abut the bolt sleeve or the face plate in the extended position. The rocker arm does not necessarily needs to be hingedly coupled and any operable coupling that will enable the rocker arm to reciprocally operate between a position where the lip is retracted in the unlocked position and protruding from the bolt's circumferential surface area in the extended locked position is likewise contemplated to be within the scope of the disclosed technology.

The term "abut" or "abuts" should not be understood to strictly mean that the respective parts must be touching. Rather, "abuts" means that any remaining space between an abutting portion will not cancel or nullify the intended operation of the abutting components. Accordingly and in an embodiment, the lip disposed on the distal end of the rocker arm can rotated in locked position and protrude out of the bolt when its rear part (or proximal end) comprising the tab contacts the head sleeve. The rotation of the rocker arm can be configured to occur under normal circumstances upon rotation of the latch key or finger lever, or in response to a prying attempt. Accordingly, in an embodiment, in an extended locked position, the distal end of the rocker arm does not extend beyond the surface area of the bolt assembly into the jamb box, while in another embodiment, in an extended locked position, the distal end of the rocker arm does extend beyond the surface area of the bolt assembly into the jamb box.

The angle defined by the tab can be adjusted to ensure the rocker arm rotates when contact is initiated between the tab and the bolt head sleeve or face plate.

The bolt used in conjunction with the fortified deadbolt latch described herein can further comprise a biaser configured to urge the proximal end of the rocker (or rocker arm) away from the bolt, thus maintaining the distal end of the rocker arm within the surface area of the bolt assembly, effectively prohibiting the distal end of the rocker arm (comprising the lip configured to engage the frame jamb box or strike plate) from protruding. The biaser can be for example, an elastic component, a silicon component, a rubber band, an elastomer, air pressure, air cylinder, a magnet, a spring component and a constant force spring (e.g., helical spring, or a torsion spring), or a combination comprising the foregoing.

Figure 8:
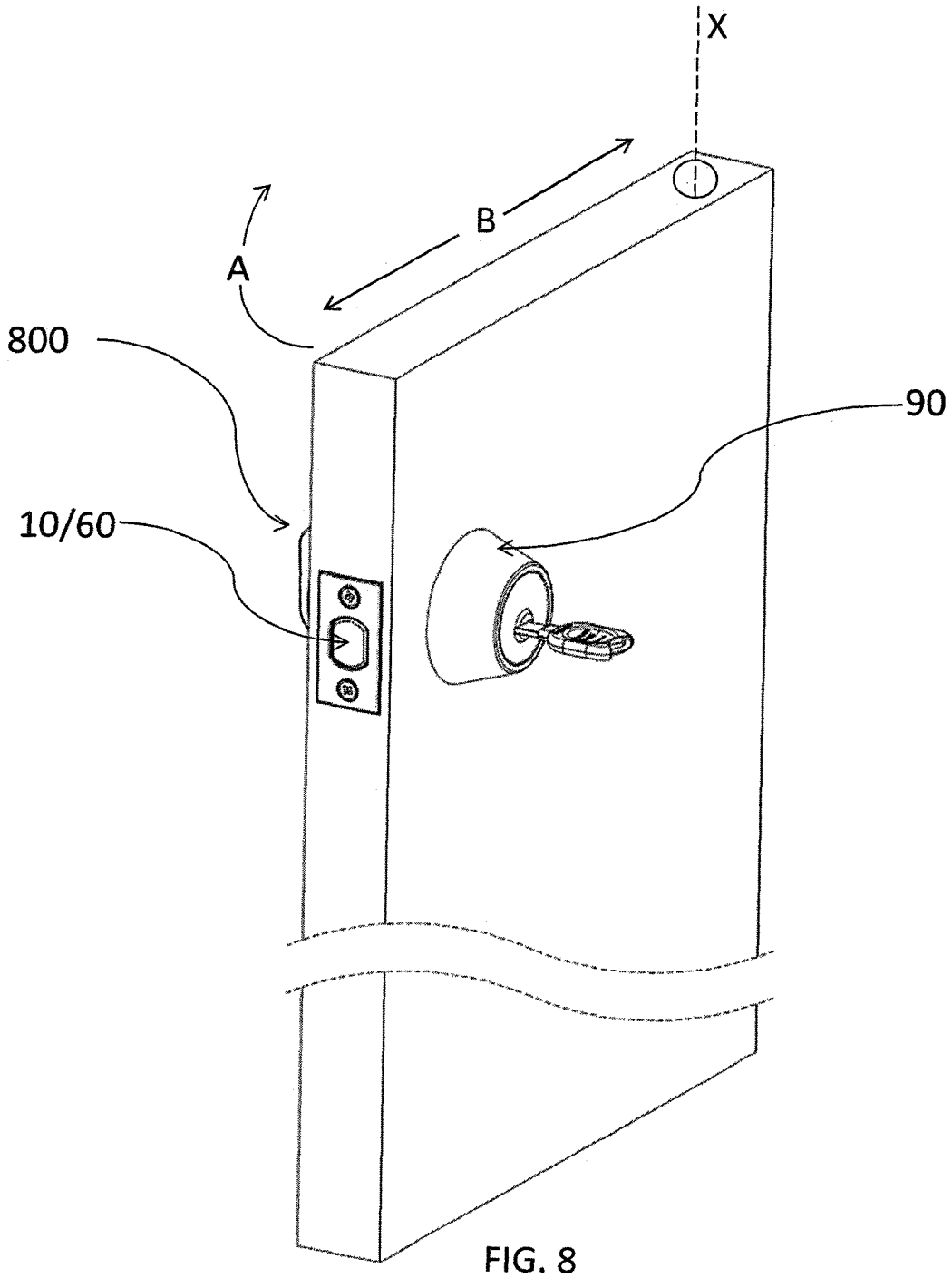
FIG. 8 is a schematic showing the door comprising an embodiment of the fortified and/or slam-proof deadbolt latch(es).

In an embodiment, the fortified deadbolt latch described herein can further comprise anti-slamming means, configured to prevent movement of the latch assembly from an unlocked position to a locked position so long as the bolt base is in close proximity to the latch assembly when a door is swung with sufficient force (See e.g., direction 'A' in FIG. 8). Accordingly and in an embodiment, the latch actuator assembly further comprising a pair of substantially flat rails having a flared proximal end and a flared distal end. The flared ends are continuous with the rail and are bent in a mirror image of each other. The flared edges can be rounded, such that the surface created is substantially circular. Other shapes are also contemplated. The flared proximal end and distal end can thus form a surface perpendicular to the longitudinal axis. The flared ends can be bent at 90° to the longitudinal axis present in the rail, or alternatively, continuously curved such that at least a portion thereof defines a surface that is perpendicular (normal) to the longitudinal axis of the housing.

The anti-slamming means can be a magnet operably coupled to the bolt base. In an embodiment, the anti-slam means can be incorporated to a deadbolt latch that does not have the prying fortification described herein. Accordingly and in another embodiment, provided herein is a slam-proof deadbolt latch device configured to reversibly move between an extended locked and retracted unlocked position, the device comprising: a latch housing having a longitudinal axis; a latch actuator assembly, the latch actuator assembly slidably coupled to the latch housing along the longitudinal axis, wherein the latch actuator assembly comprises a pair of rails having a flared proximal end and a flared distal end and wherein each of the flared proximal end and distal end forms a surface perpendicular to the longitudinal axis; a bolt assembly coupled to the latch actuator assembly; a magnet coupled to the bolt, wherein the magnet abuts the distal end of the latch actuator assembly; and a bolt sleeve or a face plate, operably coupled to the cylindrical housing.

The magnet used in conjunction with the fortified deadbolt latch device and/or the slam-proof deadbolt latch described herein, can abut the distal end of the latch actuator assembly. When used in reference to an anti-slam means, the terms "abut", or "abuts" should not be understood to strictly mean that the respective parts must be touching. Rather, "abuts" means that any remaining space between an abutting portion of the magnet with the surface created by the flared ends of the latch assembly rails is small enough to have the magnet exert a magnetic field strong enough to urge the bolt toward the rails. It should be understood though, that not in all circumstances, will the fortified deadbolt described herein contain the magnet assembly arrangement as an anti-slamming device.

Moreover, the latch actuator assembly used in conjunction with the fortified deadbolt latch device and/or the slam-proof deadbolt latch described herein, can further comprise a spindle, configured to receive an actuating member. The actuating member can be coupled to a locking cylinder's key-way and activated by the key, or in another example, by a finger lever (see e.g., 800, FIG. 8) or a knob.

In an embodiment, the latch housing used in conjunction with the fortified deadbolt latch device and/or the slam-proof deadbolt latch described herein, can define an opening providing access to the latch actuator assembly disposed laterally on both sides of the housing and can further define a dorsal slot (for example, a substantially narrow, elongated opening in the housing), configured to engage a stopper disposed on the bolt extension. As described, the bolt extension can be coupled to and movable with a bolt base.

The fortified deadbolt latch described herein can further comprise a plurality of rockers coupled in similar or different manner to the bolt. Accordingly and in an embodiment, provided herein is a fortified deadbolt latch device configured to reversibly move between an extended locked and retracted unlocked position, the device comprising: a latch housing having a longitudinal axis; a latch actuator assembly, the latch actuator assembly slidably coupled to the latch housing along the longitudinal axis; a bolt assembly coupled to the latch actuator assembly, the bolt assembly defining a circumferential surface; a rocker hingedly coupled to the bolt assembly, the rocker having a proximal end and a distal end, wherein, the distal end is configured to protrude beyond the bolt assembly's circumferential area and engage a frame jamb box in the extended position and further comprising at least at least a second rocker hingedly coupled to the bolt assembly; and a bolt sleeve or a face plate, operably coupled to the cylindrical housing. In another embodiment, provided herein is a bolt assembly, adapted to be coupled to a latch assembly or a backset (or latch assembly), the backset being a fixed backset or an adjustable backset, the bolt assembly defining a circumferential surface; a rocker hingedly (may extend to sliding or other type of movement) coupled to the bolt assembly, the rocker having a proximal end and a distal end, wherein, the distal end of the rocker can be configured to protrude beyond the bolt assembly's circumferential area and engage a frame jamb box when the rocker's proximal end contacts an actuator, for example; a bolt head sleeve or a face plate.

For example, the backset can be an adjustable backset. Accordingly, provided herein is a deadbolt, a cylinder-housing, a lock cylinder (having a keyway), an actuator formed with a hub connectable to a lock cylinder, the hub being journaled (in other words, an arrangement of parts where one part can rotate inside the other or slide in an arc along the other) in the cylinder-housing, and a latch railing coupling the actuator to the deadbolt via at least one of a plurality of attachment sites on the deadbolt and the latch railing. The attachment sites can be, for example, notches formed on a periphery of the deadbolt or on the latch railing. The deadbolt can be configured to be slidingly disposed in a tube, and the latch railing, the actuator and the deadbolt can be selectively removable from the cylindrical housing. Further a pin can be disposed between the cylindrical housing and a cylinder-connecting portion, the pin being selectibly advanced inwards into a hole formed in the cylinder-connecting portion so as to release the cylindrical housing from the cylinder-connecting portion, thereby permitting withdrawing the cylinder-connecting portion, the actuator, the latch railing and the deadbolt from the housing. The deadbolt can be configured to have a length such that the deadbolt extends to one of various mounting provisions when the latch railing fits into one of the notches in other words, the attachment sites). formed on the deadbolt. The mounting provisions disclosed, can be, for example, mounting holes spaced from one another corresponding to a spacing between mounting screws of the lock cylinder. Accordingly, a strike can be coupled to the tube wherein a distance, in other words "a backset", between an outer surface of the strike (plate) and a center of the hub (in other words, the aperture defined in the door to receive and install the locking cylinder) is defined by the notch in which the latch railing is fitted. The backset can vary from between about, for example, 60 mm (2.36 inch) to about 70 mm (2.75 inch). Other adjustment lengths are also contemplated and the range described is for example only. For example, a short adjustable backset can also be used, wherein the adjustable backset can vary from between about 44 mm (1.75 inch) and about 51 mm (2.0 inches).

The bolt used in conjunction with the fortified deadbolt latch described herein, or adapted to be coupled to a fixed or adjustable backset, comprising a plurality of rockers can define at least a second beveled channel therein along the longitudinal axis, configured to receive at least a portion of the at least second rocker. In addition, the bolt can further comprise at least a second biaser configured to urge the proximal end of the at least second rocker away from the bolt and the bolt head can define at least a second slit therein, adapted to allow reversible movement of the at least second rocker. The rockers (and slits) can be arranged such that they protrude laterally at, for example a 180° (or other angle) from each other. The skilled artisan would readily recognize that frame jamb boxes and coupled strike plates do not necessarily have to have a rectangular cross section. Accordingly, the number of rockers and their spatial orientation can be adapted to provide proper fortification against prying attempts at each configuration. For example, three (3) rocker arms at 120°, or two on the same plane and one rocker at 90° to that plane, or in another example, four rocker (arms) at 90° to each other. Similarly, the single rocker can be configured to protrude dorsal (above) to the bolt, ventral (below) to the bolt or lateral to the bolt, as determined based on the orientation of the door and the most probable prying action. Likewise, when two rocker arm s are used, the orientation between the rocker arm s can be on the same plane (in other words at 180°), or perpendicular to each other (in other words, in 90°). To reiterate, decision on the preferred orientation of the rocker arm can be made based on the door (or opening closure) orientation relative to the hinges and the most probable prying direction(s).

The fortified deadbolt latches and/or the anti-slam deadbolt latches described herein, can be a part of a kit and are also thus contemplated. Accordingly, provided herein is a kit comprising a fortified deadbolt latch device configured to reversibly move between an extended locked and retracted unlocked position, the device comprising a latch housing having a longitudinal axis; a latch actuator assembly, the latch actuator assembly slidably coupled to the latch housing along the longitudinal axis; a bolt assembly coupled to the latch actuator assembly, the bolt defining a circumferential surface; a rocker hingedly coupled to the bolt assembly, the rocker having a proximal end and a distal end, wherein, the distal end is configured to protrude beyond the bolt assembly's circumferential area and engage a frame jamb box in the extended position; and a bolt sleeve or a face plate, operably coupled to the latch housing; a lock cylinder; optionally: a handle, a key, a finger lever, a rosette, an escutcheon, a strike plate, or a combination comprising one or more of the foregoing; optionally packaging; and optionally instructions. Likewise, contemplated is a door, or a hinged closure (e.g., a window) configured to operate between a closed and an open position comprising the deadbolt latches and/or the anti-slam deadbolt latches described herein, whether with a single rocker arm.

The lock cylinder can comprise a barrel; a column extending from the barrel, the column having at least two column apertures; a cylinder configured to rotate within the barrel, the cylinder including a guide way sized and configured to receive a key blade, the cylinder including a cylinder aperture axially registered with the column aperture when the lock assembly is locked, and movable out of registration with the column aperture with the key blade to unlock the lock assembly; a first and a second pin captured by one of the cylinder and the column, each of the first and second pins having a locking pin portion captured within the cylinder and slidable in the cylinder aperture and a locking safety pin portion captured within the column and slidable in the column aperture, the pins normally being biased to a locking position with the locking pin portion within the cylinder aperture and the locking safety pin portion within the column aperture to lock the cylinder relative to the barrel.

In an embodiment, the fortified deadbolt latches described herein can further comprise, and be operably coupled to the lock cylinder described herein.

A more complete understanding of the components, methods, and devices disclosed herein can be obtained by reference to the accompanying drawings. These figures (also referred to herein as "FIG.") are merely schematic representations based on convenience and the ease of demonstrating the present disclosure, and are, therefore, not intended to indicate relative size and dimensions of the devices or components thereof, their relative size relationship and/or to define or limit the scope of the exemplary embodiments. Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function. Likewise, cross sections are referred to on normal orthogonal coordinate system having XYZ axis, such that Y axis refers to front-to-back, X axis refers to side-to-side, and Z axis refers to up-and-down.

Turning now to FIG. 1, illustrating an exploded view of an embodiment of the fortified deadbolt latch device described herein, where as shown, fortified deadbolt latch 10 comprises latch housing 100 having a longitudinal axis (not shown), housing 100 defining openings 101, 101' (not shown, see e.g., FIGS. 4 and 5) providing access to latch actuator assembly 200 disposed laterally and dorsal slot 102 configured to engage stopper 309 disposed on bolt extension 302 with distal end 103 of latch housing 100. Latch actuator assembly 200 is slidably coupled to latch housing 100 along the longitudinal axis.

As illustrated, latch actuator assembly 200 can further comprise rails 205, 206, having flared proximal end 204, 208 respectively, and flared distal end 201, 207 respectively, wherein each of flared proximal end 204, 208 and distal end 201, 207 form a surface perpendicular to the longitudinal axis.

FIG. 1 also illustrates bolt assembly 350 coupled to latch actuator assembly 200, bolt assembly 350 defining a circumferential surface and comprising bolt extension 302 having stopper 309 thereon, coupled to and movable with bolt base 303 with bolt 305 having a longitudinal axis. Bolt 305 defining beveled channel 308 recessed therein along the longitudinal axis of bolt 305, configured to receive at least a portion of rocker (or, in other words, rocker arm) 310 and bolt head 320, which can be disposed over bolt 305 and define slit 321 therein, adapted to allow reversible movement of rocker 310. Rocker 310 can be hingedly coupled to bolt assembly 350 through bore 315 and axle pin 306. Rocker 310 is illustrated as having proximal end with tab 312 and distal end with lip 311, wherein, lip 311 on the distal end can be configured to protrude beyond bolt assembly 350 circumferential area defined by bolt head 320 and engage frame jamb box (605 see e.g., FIG. 4) in the extended position. Proximal end tab 312 can be biased away from beveled channel 308 of bolt 305 by biaser 307. Biaser 307 can be configured to bias proximal end tab 312 away from the surface of channel 308 defined in bolt 305 longitudinally. Also shown is bolt sleeve 400, operably coupled to latch housing 100. FIG. 1 also illustrates pin 304 configured to couple bolt head 320 and bolt 305, as well as magnet 300 coupled to bolt base 303 proximal end via fixer 301, for example a screw. Also shown is spindle 202 configured to receive and engage a latch assembly 200 actuating lever (not shown). Although the figure(s) show the fortified bolt attached to a double (adjustable) backset (i.e. latch assembly), the skilled artisan would readily recognize that the same can be applied to a fixed (single) backset.

Figure 2:
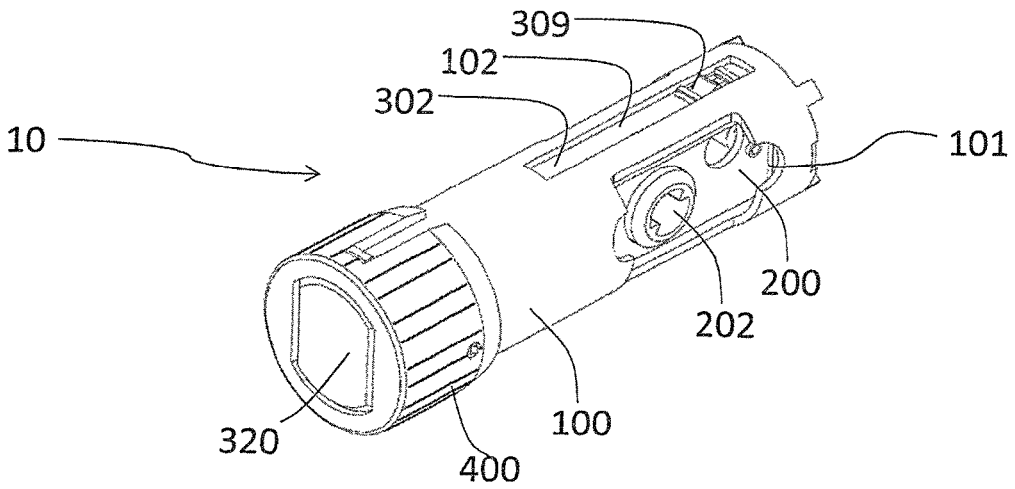
FIG. 2, is an illustration of an embodiment of the fortified deadbolt latch device in a retracted, unlocked position.
Figure 3:
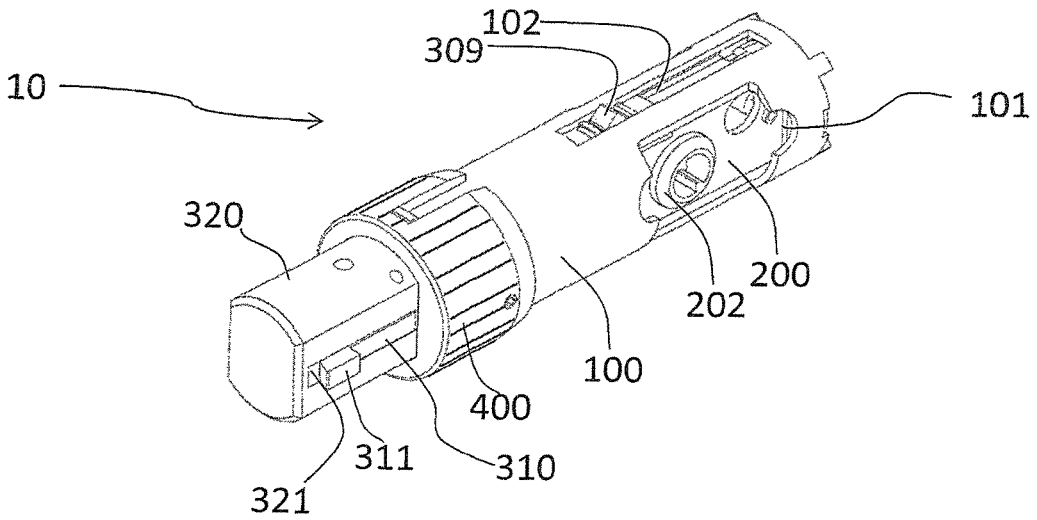
FIG. 3, is an illustration of an embodiment of the fortified deadbolt latch device in an extended, locked position.

Turning now to FIGS. 2 and 3, illustrating an embodiment of the fortified deadbolt latch device in a retracted, unlocked position (FIG. 2) and the extended locked position (FIG. 3). As illustrated, in the retracted unlocked position, fortified deadbolt latch 10, comprises latch housing 10, coupled to bolt head sleeve 400, defining lateral openings 101, 101' (not shown, see e.g., FIG. 4) and providing access to an actuating lever through spindle 202 in latch assembly 200, with dorsal slot 102 engaging bolt extension 302 (FIG. 2) having stopper 309 at the proximal end of latch housing 100. As shown in FIG. 2, bolt head 320 is flush with the distal end surface of bolt head sleeve 320. Conversely, FIG. 3 illustrates fortified deadbolt latch 10 in the extended locked position, where lip 311 disposed on rocker arm 310 distal end protrudes through slit 321 defined in bolt head 320 adapted to engage frame jamb box 605 (see e.g., FIG. 4). As illustrated, bolt extension 302 has shifted toward latch housing 100 distal end 103 (not shown see e.g., FIG. 1) with stopper 309 engaged in slot 102 of latch housing 100.

Figure 4:
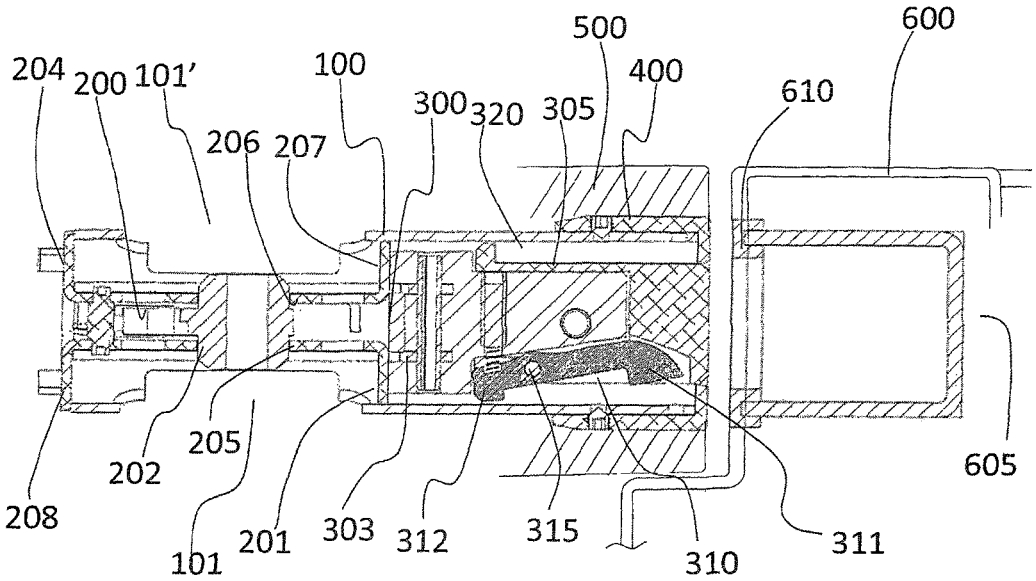
FIG. 4, is a X-Y cross section illustration of an embodiment of the fortified deadbolt latch device and a frame jamb box in a retracted, unlocked position.
Figure 5:
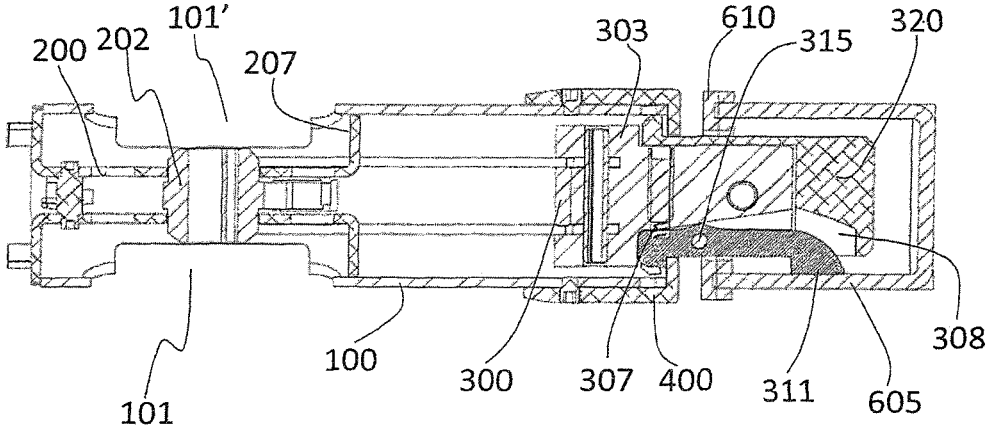
FIG. 5, is a X-Y cross section illustration of an embodiment of the fortified deadbolt latch device and a frame jamb box in an extended, locked position.

Turning now to FIGS. 4, and 5, illustrating X-Y cross section of an embodiment of fortified deadbolt latch 10 and frame (or another door's) 600 jamb box 605 coupled to strike plate 610 in the retracted unlocked position (see e.g., FIG. 4), and the extended locked position (FIG. 5). As illustrated in FIG. 4, in the retracted unlocked position, fortified deadbolt latch 10 can comprise latch housing 100 having a longitudinal axis (not shown), defining openings 101, 101' providing access to latch actuator assembly 200 disposed laterally. Latch actuator assembly 200 is slidably coupled to latch housing 100 along the longitudinal axis having rails 205, 206, having flared proximal end 204, 208 respectively, and flared distal end 201, 207 respectively, wherein each of flared proximal end 204, 208 and distal end 201, 207 form a surface perpendicular to the longitudinal axis. In the retracted unlocked position, magnet 300 can (optionally) be coupled (in certain embodiments) to bolt base 303 proximal end via fixer 301 (not shown see e.g., FIG. 1), for example a screw and act as anti-slam device, exerting force on ferrous surface created by flared distal end 201, 207 of rails 205 and 206 respectively. As shown in FIG. 4, Rocker arm 310 has lip 311 disposed toward the distal end of rocker arm 310, with tab 312 disposed at the proximal end, being biased outwardly with biaser 307 (see e.g., FIG. 5), rotating rocker arm 310 about its axle defined by bore 315 configured to receive and engage axle pin 306 (not shown, see e.g., FIG. 1), maintaining lip 311 inside recessed channel 308 (see e.g., FIG. 5). also shown in FIG. 4, are bolt 305 covered by bolt head 320 with its distal end flush against the distal end surface of bolt head sleeve 400. Fortified deadbolt latch 10 is embedded in door 500, configured to engage frame (or another door's) jamb box 605.

In the extended locked position illustrated in FIG. 5, bolt 305 (see e.g., FIG. 4) and bolt head 320 have shifted forward, extending into frame jamb 605 such that rocker arm 310 with lip 311 disposed toward the distal end of rocker arm 310 (see e.g., FIG. 4), with tab 312 (see e.g., FIG. 4), disposed at the proximal end, abutting bolt head sleeve 400 has caused tab 312 to overcome the biasing force of biaser 307, rotating rocker arm 310 about its axle defined by bore 315 configured to receive and engage axle pin 306 (not shown, see e.g., FIG. 1), urging lip 311 out of recessed channel 308 to engage frame (or another door's) jamb box 605.

Figure 6:
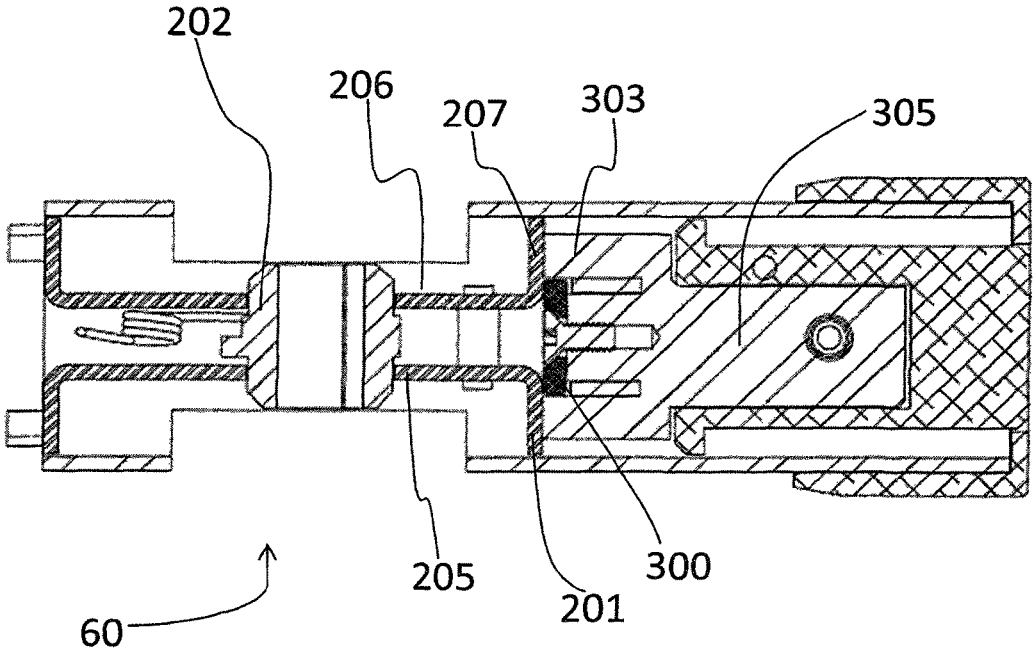
FIG. 6, is a X-Y cross section illustration of an embodiment of the slam proof deadbolt latch device in a retracted, open position.

Turning now to FIG. 6, showing a X-Y cross section illustration of an embodiment of slam-proof deadbolt latch device 60 in a retracted, open position, where magnet 300 can be coupled to bolt 305 base 303 proximal end via fixer 301 (not shown see e.g., FIG. 1), for example a screw and act as anti-slam device, exerting force on ferrous surface created by flared distal end 201, 207 of rails 205 and 206 respectively (see e.g., FIGS. 1, 4, and 5) having spindle 202 coupled thereto. As illustrated the slam proof deadbolt does not necessarily need to be used with the prying fortification as illustrated in FIGS. 4, 5 and 7A and 7B).

Figure 7A:
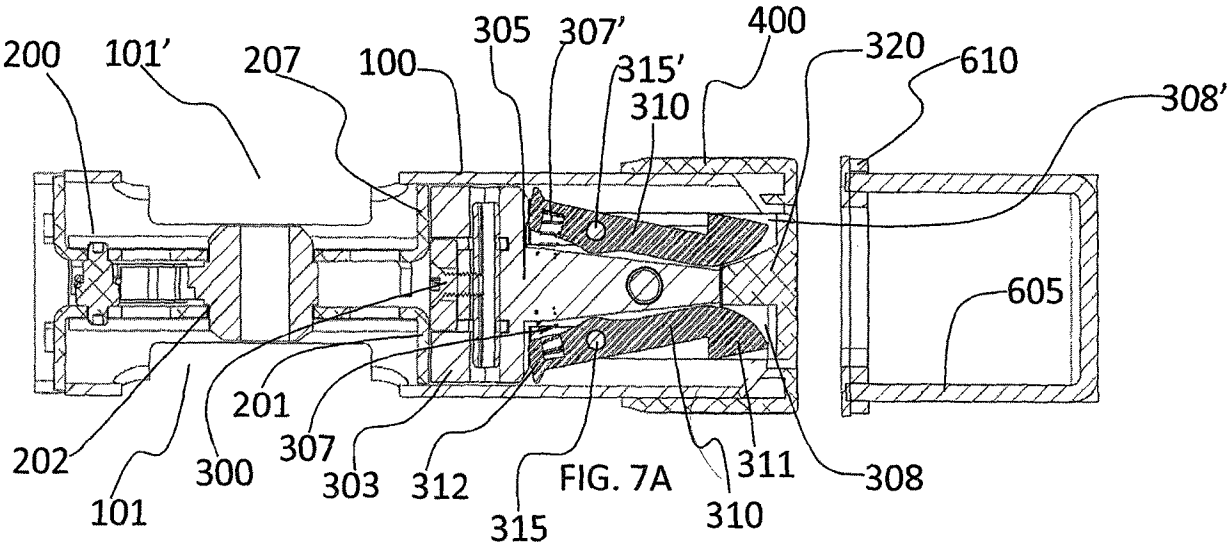
FIG. 7A is a X-Y cross section illustration of another embodiment of the fortified deadbolt latch device and a frame jamb box in a retracted, unlocked position and in an extended, locked position illustrated in FIG. 7B.
Figure 7B:
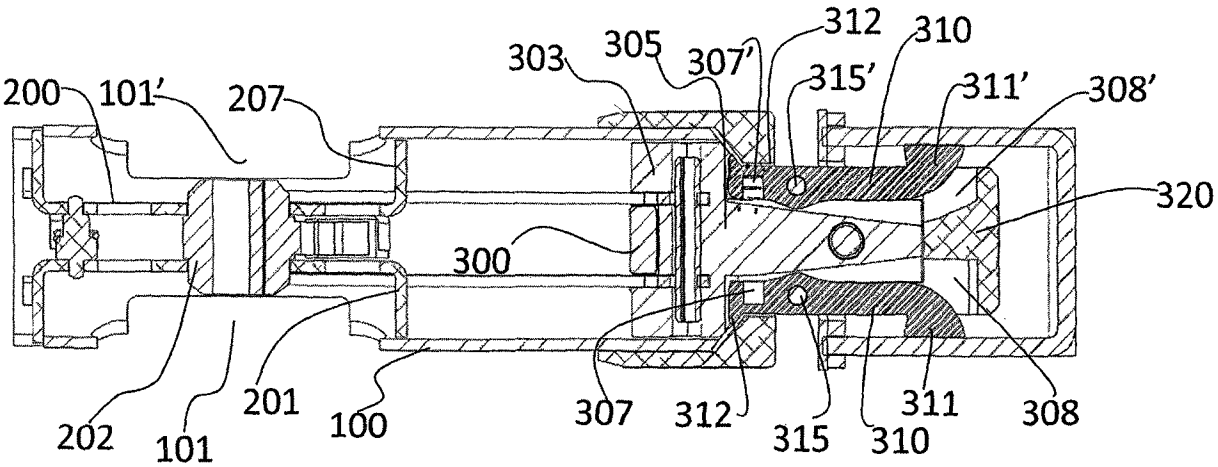

Turning now to FIG. 7, showing a X-Y cross section illustration of another embodiment of fortified deadbolt latch device 10 and frame jamb box 605 in a retracted, unlocked position (FIG. 7A) and in an extended, locked position (FIG. 7B). As illustrated in FIG. 7A, in the retracted unlocked position, fortified deadbolt latch 10 comprising latch housing 100 having a longitudinal axis (not shown), defining openings 101, 101' (not shown, see e.g., FIGS. 1, 4, and 5) providing access to latch actuator assembly 200 disposed laterally. Latch actuator assembly 200 having spindle 202 coupled thereto, is slidably coupled to latch housing 100 along the longitudinal axis having rails 205, 206, having flared proximal end 204, 208 respectively, and flared distal end 201, 207 respectively, wherein each of flared proximal end 204, 208 and distal end 201, 207 form a surface perpendicular to the longitudinal axis (not shown, see e.g., FIGS. 1, 4, and 5). In the retracted unlocked position, magnet 300 can be coupled to bolt base 303 proximal end via fixer 301 (not shown see e.g., FIG. 1), for example a screw and act as anti-slam device, exerting force on ferrous surface created by flared distal end 201, 207 of rails 205 and 206 respectively. As shown in FIG. 7A, a pair of rocker arms 310, 310' have lip 311, 311' disposed toward the distal end of rocker arm 310 and 310' respectively, with tabs 312, 312' disposed at the proximal end of rocker arms 310, 310' respectively. Tabs 312, 312' are being biased outwardly with biasers 307, 307', rotating rocker arms 310, 310' about their axle defined by bores 315, 315' configured to receive and engage axle pins 306 (not shown, see e.g., FIG. 1), maintaining lips 311, 311' inside recessed channels 308, 308' defined in bolt 305. Also shown in FIG. 7A, are bolt 305 covered by bolt head 320 with its distal end flush against the distal end surface of bolt head sleeve 400. As illustrated, rocker arms 310, 310' are disposed laterally on bolt 305, at 180° to each other on the same plane.

In the extended locked position, or in response to a prying attempt and as illustrated in FIG. 7B, bolt 305 and bolt head 320 have shifted forward, extending into frame jamb 605 such that rocker arms 310, 310' with lips 311, 311' disposed toward the distal end of rocker arms 310, 310', with tabs 312, 312' disposed at the proximal end, are now abutting bolt head sleeve 400, causing tabs 312, 312' to overcome the biasing force of biasers 307, 307' (not shown, see e.g., FIG. 7A), rotating rocker arms 310, 310' about their axle defined by bore 315, 315' configured to receive and engage axle pins 306 (not shown, see e.g., FIG. 1), urging lips 311, 311' out of recessed channels 308, 308' defined in bolt 305, to engage frame (or another door's) jamb box 605.

The term "about", when used in the description of the technology and/or claims means that amounts, sizes, formulations, parameters, and other quantities and characteristics are not and need not be exact, but may be approximate and/or larger or smaller, as desired, reflecting tolerances, conversion factors, rounding off, measurement error and the like, and other factors known to those of skill in the art. In general, an amount, size, formulation, parameter or other quantity or characteristic is "about" or "approximate" whether or not expressly stated to be such and may include the end points of any range provided including, for example ±25%, or ±20%, specifically, ±15%, or ±10%, more specifically, ±5% of the indicated value of the disclosed amounts, sizes, formulations, parameters, and other quantities and characteristics.

All ranges disclosed herein are inclusive of the endpoints, and the endpoints are independently combinable with each other. "Combination" is inclusive of blends, mixtures, alloys, reaction products, and the like. Furthermore, the terms "first," "second," and the like, herein do not denote any order, quantity, or importance, but rather are used to denote one element from another. The terms "a", "an" and "the" herein do not denote a limitation of quantity, and are to be construed to cover both the singular and the plural, unless otherwise indicated herein or clearly contradicted by context. The suffix "(s)" as used herein is intended to include both the singular and the plural of the term that it modifies, thereby including one or more of that term (e.g., the device(s) includes one or more device). Reference throughout the specification to "one embodiment", "another embodiment", "an embodiment", and so forth, means that a particular element (e.g., feature, structure, and/or characteristic) described in connection with the embodiment is included in at least one embodiment described herein, and may or may not be present in other embodiments. In addition, it is to be understood that the described elements may be combined in any suitable manner in the various embodiments.

Accordingly, provided herein is a fortified deadlock latch device configured to reversibly (or, in other words, reciprocally) move between, or alternate between an extended locked and retracted unlocked position, the device comprising: a cylindrical housing having a longitudinal axis; a latch actuator assembly, the latch actuator assembly slidably coupled to the cylindrical housing along the longitudinal axis; a bolt assembly coupled to the latch actuator assembly, the bolt defining a circumferential surface; a rocker hingedly coupled to the bolt assembly, the rocker having a proximal end and a distal end, wherein, the distal end is configured to protrude beyond the bolt assembly's circumferential area and engage a frame jamb box in the extended position; and a bolt sleeve or a face plate, operably coupled to the cylindrical housing wherein (i) the bolt assembly further comprises: a bolt extension coupled to and movable with a bolt base; a bolt base; a bolt having a longitudinal axis, the bolt defining a beveled channel therein along the longitudinal axis, configured to receive at least a portion of the rocker; and a bolt head, disposed over the bolt and defining a slit therein, adapted to allow reversible movement of the rocker (ii) the rocker comprising a lip disposed on the distal end, wherein the lip is configured to engage a frame jamb box; a rocker bore, configured to receive and engage an axle pin, the axle pin being operably coupled to the bolt; and a tab disposed on the proximal end, the tab configured to abut the bolt sleeve or the face plate in the extended position, (iii) the bolt further comprising a biaser configured to urge the proximal end of the rocker away from the bolt's axial dimension (in other words, the surface of the channel), wherein (iv) the bolt assembly further comprises a magnet coupled to the bolt base, wherein (v) the latch actuator assembly further comprising a pair of rails having a flared proximal end and a flared distal end, wherein each of the flared proximal end and distal end forms a surface perpendicular to the longitudinal axis and wherein the median portion of the rails are parallel to the longitudinal axis of the latch actuator assembly, (vi) the magnet abuts the distal end of the latch actuator assembly—acting as a slamming prevention component, wherein (vii) the latch actuator assembly further comprises a spindle, configured to receive an actuating member, and coupling means configured to operably couple to a locking cylinder, wherein (viii) the cylindrical housing defines an opening providing access to the latch actuator assembly disposed laterally and optionally, a dorsal slot configured to engage a stopper disposed on the bolt extension, the bolt assembly (ix) further comprising at least at least a second rocker hingedly coupled to the bolt assembly, wherein (x) the bolt defines at least a second beveled channel therein along the longitudinal axis, configured to receive at least a portion of the at least second rocker, (xi) the second rocker comprising: a lip disposed on the distal end, wherein the lip is configured to engage a frame jamb box (e.g., at a spot that is different than the first rocker arm lip); a rocker arm bore, configured to receive, accommodate and engage an axle pin, the axle pin being operably coupled to the bolt thereby hingedly coupling the rocker arm to the bolt; and a tab disposed on the proximal end, the tab configured to abut the bolt sleeve or the face plate in the extended position, (xii). the bolt further comprising at least a second biaser configured to urge the proximal end of the second rocker arm away from the bolt's longitudinal axis-parallel surface, wherein, (xiii) the bolt head, defines at least a second slit therein, adapted to allow and accommodate reversible or reciprocating movement of the at least second rocker arm, (xiv) the second rocker is disposed at a 180° angle to a first rocker, or (xv) at a 90° degrees to the first rocker.

In another embodiment, provided herein is a kit comprising: the fortified locking deadlock device described herein; a lock cylinder; and optionally: a handle, a key, a finger lever, a rosette an escutcheon, or a combination comprising one or more of the foregoing; optionally packaging; and optionally instructions, wherein (xvi) the locking cylinder comprising: a barrel; a column extending from the barrel, the column having at least two column apertures; a cylinder configured to rotate within the barrel, the cylinder including a guide way sized and configured to receive a key blade, the cylinder including a cylinder aperture axially registered with the column aperture when the lock assembly is locked, and movable out of registration with the column aperture with the key blade to unlock the lock assembly; a first and a second pin captured by one of the cylinder and the column, each of the first and second pins having a locking pin portion captured within the cylinder and slidable in the cylinder aperture and a locking safety pin portion captured within the column and slidable in the column aperture, the pins normally being biased to a locking position with the locking pin portion within the cylinder aperture and the locking safety pin portion within the column aperture to lock the cylinder relative to the barrel.

In yet another embodiment, provided herein is a slamproof deadlock latch device configured to reversibly move between an extended locked and retracted unlocked position, the device comprising: a cylindrical housing having a longitudinal axis; a latch actuator assembly, the latch actuator assembly slidably coupled to the cylindrical housing along the longitudinal axis, wherein the latch actuator assembly comprises a pair of rails having a flared proximal end and a flared distal end and wherein each of the flared proximal end and distal end forms a surface perpendicular to the longitudinal axis; a bolt assembly coupled to the latch actuator assembly; a magnet coupled to the bolt, wherein the magnet abuts the distal end of the latch actuator assembly; and a bolt sleeve or a face plate, operably coupled to the cylindrical housing, wherein (xvii) the bolt assembly further comprises: a bolt extension coupled to and movable with a bolt base; a bolt base; a bolt having a longitudinal axis, the bolt defining a beveled channel therein along the longitudinal axis, configured to receive at least a portion of the rocker; and a bolt head, disposed over the bolt and defining a slit therein, adapted to allow reversible movement of the rocker (xviii) the rocker comprising a lip disposed on the distal end, wherein the lip is configured to engage a frame jamb box; a rocker bore, configured to receive and engage an axle pin, the axle pin being operably coupled to the bolt; and a tab disposed on the proximal end, the tab configured to abut the bolt sleeve or the face plate in the extended position, (xix) the bolt further comprising a biaser configured to urge the proximal end of the rocker away from the bolt's axial dimension (in other words, the surface of the channel), wherein (xx) the latch actuator assembly further comprises a spindle, configured to receive an actuating member, and coupling means configured to operably couple to a locking cylinder, wherein (xxi) the cylindrical housing defines an opening providing access to the latch actuator assembly disposed laterally and optionally, a dorsal slot configured to engage a stopper disposed on the bolt extension, the bolt assembly further comprising (xxii) at least a second rocker hingedly coupled to the bolt assembly, wherein (xxiii) the bolt defines at least a second beveled channel therein along the longitudinal axis, configured to receive at least a portion of the at least second rocker, (xxiv), the second rocker comprising: a lip disposed on the distal end, wherein the lip is configured to engage a frame jamb box (e.g., at a spot that is different than the first rocker arm lip); a rocker arm bore, configured to receive, accommodate and engage an axle pin, the axle pin being operably coupled to the bolt thereby hingedly coupling the rocker arm to the bolt; and a tab disposed on the proximal end, the tab configured to abut the bolt sleeve or the face plate in the extended position, (xxv). the bolt further comprising at least a second biaser configured to urge the proximal end of the second rocker arm away from the bolt's longitudinal axis-parallel surface, wherein, (xxvi) the bolt head, defines at least a second slit therein, adapted to allow and accommodate reversible or reciprocating movement of the at least second rocker arm, (xxvii) the second rocker is disposed at a 180° angle to a first rocker, or (xv) at a 90° degrees to the first rocker.

While particular embodiments have been described, alternatives, modifications, variations, improvements, and substantial equivalents that are or may be presently unforeseen may arise to applicants or others skilled in the art. For example, the disclosed and claimed technology can be used with any other door bolt, where a bolt enters a jamb (or a sill) to provide additional protection for prying and optionally slamming. Accordingly, the appended claims as filed and as they may be amended, are intended to embrace all such alternatives, modifications variations, improvements, and substantial equivalents.

What is claimed:

1. A fortified deadlock latch device configured to reversibly move between an extended locked and retracted unlocked position, the device comprising:

a. a latch housing having a longitudinal axis;

b. a latch actuator assembly, the latch actuator assembly slidably coupled to the latch housing along the longitudinal axis;

c. a bolt assembly comprising i. a bolt base;

ii. a bolt extension coupled to and movable with the bolt base;

iii. a bolt coupled to the bolt base, having a longitudinal axis, the bolt defining a beveled channel therein along the longitudinal axis, configured to receive at least a portion of a rocker; and iv. a bolt head, disposed over the bolt and defining a slit therein, adapted to allow reversible movement of the rocker, the bolt assembly coupled to the latch actuator assembly, wherein the bolt defining a circumferential surface;

d. the rocker hingedly coupled to the bolt head, the rocker having a proximal end and a distal end, wherein, the proximal end is biased away from the surface of a beveled channel defined in the bolt, and the distal end is configured to protrude beyond the bolt assembly's bolt head's circumferential surface and engage a frame jamb box in the extended position; and e. a bolt sleeve or a face plate, operably coupled to the latch housing.

2. The device of claim 1, wherein the rocker comprises:

a. a lip disposed on the distal end, wherein the lip is configured to engage the frame jamb box;

b. a rocker bore, configured to receive and engage an axle pin, the axle pin being operably coupled to the bolt; and c. a tab disposed on the proximal end, the tab configured to abut the bolt sleeve or the face plate in the extended position.

3. The device of claim 2, wherein the bolt further comprises a biaser configured to urge the proximal end of the rocker away from the bolt.

4. The device of claim 1, wherein the latch actuator assembly further comprising a pair of rails having a flared proximal end and a flared distal end, wherein each of the flared proximal end and distal end forms a surface perpendicular to the longitudinal axis.

5. The device of claim 4, wherein the bolt assembly further comprises a magnet coupled to the bolt base, the magnet sized and configured to exert a magnetic field strong enough to urge the bolt toward the rails.

6. The device of claim 5, wherein the magnet abuts the distal end of the latch actuator assembly.

7. The Device of claim 4, wherein the latch actuator assembly further comprises a spindle, configured to receive an actuating member.

8. The device of claim 1, wherein the latch housing defines an opening providing access to the latch actuator assembly disposed laterally and a dorsal slot configured to engage a stopper disposed on the bolt extension.

9. The device of claim 1, further comprising at least at least a second rocker hingedly coupled to the bolt head.

10. The device of claim 9, wherein the bolt defines at least a second beveled channel therein along the longitudinal axis, configured to receive at least a portion of the at least second rocker.

11. The device of claim 10, wherein the at least second rocker comprises:

a. a lip disposed on the distal end, wherein the lip is configured to engage the frame jamb box;

b. a rocker bore, configured to receive and engage an axle pin, the axle pin being operably coupled to the bolt head; and c. a tab disposed on the proximal end, the tab configured to abut the bolt sleeve or the face plate in the extended position.

12. The device of claim 11, wherein the bolt further comprises at least a second biaser configured to urge the proximal end of the at least second rocker away from the bolt.

13. The device of claim 11, wherein the bolt head, defines at least a second slit therein, adapted to allow reversible movement of the at least second rocker.

14. The device of claim 9, wherein the at least second rocker is disposed at a 180° angle to a first rocker.

15. The device of claim 1, comprising two rockers.

16. A kit comprising:

a. the fortified locking deadlock device of claim 1;

b. a lock cylinder;

c. optionally: a handle, a key, a finger lever, a rosette, an escutcheon, or a combination comprising one or more of the foregoing;

d. optionally packaging; and e. optionally instructions.

17. A swinging door comprising the fortified locking deadlock device of claim 1.

18. A slam-proof deadlock latch device configured to reversibly move between an extended locked and retracted unlocked position, the device comprising:

a. a latch housing having a longitudinal axis;

b. a latch actuator assembly, the latch actuator assembly slidably coupled to the latch housing along the longitudinal axis, wherein the latch actuator assembly comprises a pair of rails having a flared proximal end and a flared distal end and wherein each of the flared proximal end and distal end forms a surface perpendicular to the longitudinal axis;

c. a bolt assembly comprising i. a bolt base ii. a bolt extension coupled to and movable with the bolt base;

iii. a bolt coupled to the bolt base, having a longitudinal axis, the bolt defining a beveled channel therein along the longitudinal axis, configured to receive at least a portion of a rocker;

iv. a bolt head, disposed over the bolt and defining a slit therein, adapted to allow reversible movement of the rocker v. the rocker hingedly coupled to the bolt head, the rocker having a proximal end and a distal end, wherein the proximal end is biased away from the beveled channel; and the distal end is configured to protrude through the slit defined in the bolt head and engage a frame jamb box in the extended position; and d. a magnet coupled to the bolt, wherein the magnet abuts the distal end of the latch actuator assembly, the magnet sized and configured to exert a magnetic field strong enough to urge the bolt toward the rails; and e. a bolt sleeve or a face plate, operably coupled to the latch housing.

19. The device of claim 18, wherein the latch actuator assembly further comprises a spindle, configured to receive an actuating member.

* * * * *